US005740498A

United States Patent [19]

Tsuchiya

[11] Patent Number: 5,740,498

[45] Date of Patent: Apr. 14, 1998

[54] PAPER DUST REMOVAL DEVICE FOR USE IN AN IMAGE FORMING APPARATUS

[75] Inventor: Hiroaki Tsuchiya, Osaka, Japan

[73] Assignee: Mita Industrial Co., Ltd., Osaka-fu, Japan

[21] Appl. No.: 804,706

[22] Filed: Feb. 21, 1997

[30] Foreign Application Priority Data

Mar. 12, 1996 [JP] Japan ..... 8-054785

[51] Int. Cl.[6] ..... G03G 21/00

[52] U.S. Cl. ..... 399/98; 399/123

[58] Field of Search ..... 399/91, 98, 99, 399/101, 121, 123, 343, 388, 390

[56] References Cited

U.S. PATENT DOCUMENTS

| | | | |
|---|---|---|---|
| 4,370,050 | 1/1983 | Matsui et al. | 399/99 |
| 4,750,018 | 6/1988 | Gooray et al. | 399/390 |
| 5,211,760 | 5/1993 | Kedarnath | 399/343 X |
| 5,386,274 | 1/1995 | Sanpe et al. | 399/101 |
| 5,436,700 | 7/1995 | Kikuchi et al. | 399/98 X |
| 5,568,243 | 10/1996 | Durfee et al. | 399/98 |
| 5,614,997 | 3/1997 | Marumoto | 399/121 |

*Primary Examiner*—Sandra L. Brase
*Attorney, Agent, or Firm*—Jordan and Hamburg

[57] ABSTRACT

A paper dust removal device detachably mountable to a frame of an image forming apparatus through an opening formed on the frame to remove paper dusts from an outer surface of a roller in the image forming apparatus, the opening of the frame being opposing to the outer surface of the roller, the paper dust removal device includes: a base member; a paper dust holding member fixedly attached to the base member adapted to press contact with the outer surface of the roller; and engaging member engageable with the frame when the paper dust removal device is rotated in an engaging direction due to a friction force generated on the outer surface of the roller by a contact of the paper dust holding member with the outer surface of the roller.

6 Claims, 7 Drawing Sheets

PAPER DUST REMOVAL DEVICE FOR USE IN AN IMAGE FORMING APPARATUS

BACKGROUND OF THE INVENTION

This invention relates to a paper dust removal device for use in an image forming apparatus such as copying machine and facsimile machine to remove paper dusts in the form of minute powder (hereinafter simply referred to as "paper dusts"), generated from copy sheets, which are likely to be adhered on a surface of a roller.

A paper dust removal device has been conventionally used in image forming apparatuses such as copying machine and facsimile machine to remove paper dust liable to be adhered and cumulatively deposited on a surface of a registration roller disposed upstream of an image transfer unit, thereby securing good image transfer onto a sheet of copy paper.

FIG. 8 is a cross sectional side view showing an exemplified arrangement of registration roller pair and paper dust removal device of the prior art.

In FIG. 8, indicated at 3 is a registration roller pair, and 5 is a conventional paper dust removal device. The registration roller pair 3 comprises an upper roller 1 and a lower roller 2. The upper roller 1 and lower roller 2 are disposed opposing to each other with their respective outer circumferential portions in contact with a specified pressure to allow a copy sheet to pass therebetween. Rotary axes about which the upper and lower rollers 1 and 2 are rotated are arranged in parallel to each other. Rotations of the upper and lower rollers 1 and 2 are in timed with transport of a copy sheet 4 passing through the rollers 1 and 2 in a state that a lead end of the copy sheet 4 is securely nipped between the contact portions (outer circumferential portions) of the rollers 1 and 2.

The copy sheet 4 has an image transferred on the same side thereof as the upper roller 1 is located. Accordingly, the paper dust removal device 5 is provided at an appropriate position near the outer circumferential portion of the upper roller 1 in a state that it is fixedly attached to a frame 6. The frame 6 has a substantially U-shape in cross section. The paper dust removal device 5 extends substantially over the axial length of the upper roller 1 in parallel with the rotary axis of the upper roller 1.

The paper dust removal device 5 is constructed as below. A dust holding member (brush) 8 composed of felt-like acrylic fiber is fixedly mounted on one side of an elastic member (sponge) 7, which is fixedly attached to the frame 6 at the opposite side of the brush 8 by means of double-sided adhesive tape 9 whose opposite sides have adhesive property. A lead end of the paper dust holding member 8 comes into pressing contact with the outer circumferential surface of the upper roller 1 over its entire length.

With this construction, when the registration roller pair 3 is rotated, paper dusts adhered on the surface of the upper roller 1 are brushed off and collected (absorbed) by the dust holding, member 8 in pressing contact with the upper roller 1 and held therein to thereby remove the paper dusts from the roller surface.

The paper dust removal device 5 is further provided with a polyethylene terephtalate film (hereinafter merely referred to as PET film) to receive overflowed dusts from the brush 8 and to prevent the overflowed dusts from falling onto the surface of the copy sheet 4. The PET film 10 has an upright portion and a slope extending slightly downward toward the roller 1 from the lower end of the upright portion in an attached state. The PET film 10 is attached to the frame 6 in a state that the upright portion is sandwiched between the sponge 7 and the frame 6 via the adhesive tape 9. The film 10 extends substantially over the entire length of the upper roller 1 in a state that a lead end of the film 10 comes into contact with the outer circumferential surface of the roller 1 over its entire length.

With this arrangement, when the copy sheet 4 is transported from a cassette toward the registration roller pair 3, paper dusts which have been attracted from the copy sheet 4 and adhered on the outer circumferential surface of the upper roller 1 can be brushed off and collected by the dust holding member 8 made of felt-like fiber and thus removed from the roller surface.

Thereafter, a lead end of the copy sheet 4 is temporarily nipped between the upper and lower rollers 1 and 2 and transported to the image transfer unit as timed with an image transfer operation. Then, a toner image is transferred to the copy sheet 4 in the image transfer unit in a favorable state, and the copy sheet 4 after the image transfer is discharged onto a discharge tray via a fixing unit.

In the thus constructed paper dust removal device 5 of the prior art, paper dusts adhered on the outer circumferential surface of the upper roller 1 are collected by the felt-like dust holding member 8 and held therein. This paper dust removal device 5 has the following drawback.

When paper dusts are cumulatively collected by the dust holding member 8 to some extent, the dust holding member 8 cannot hold the dusts therein any more and the dusts beyond a specified amount overflow. Accordingly, regular maintenance such as cleaning of the device 5 or replacing with a new device is necessitated. When such maintenance is conducted, the paper dust removal device 5 has to be detached from the frame 6. However, since the device 5 is fixedly attached to the frame 6 over its entire length in the axial direction of the upper roller 1 by the adhesive tape 9, the detaching operation is very cumbersome. Particularly, the detaching operation becomes difficult because a service person has to detach the device 5 together with the adhesive tape 9 from the frame 6, putting his hand(s) inside a main body of the image forming apparatus where various peripheral units for image formation are densely arranged.

This drawback is also applied to a mounting operation of the device 5 to the frame 6. The device 5 in elongated shape whose length extends substantially over the axial length of the upper roller 1 should be fixedly attached to the frame 6 by the adhesive tape 9 in such a way that the longitudinal direction thereof is completely in alignment, i.e., in parallel with the rotary axis of the upper roller 1. A service person has to do this cumbersome operation, putting his hand(s) inside the apparatus main body where various peripheral units for image formation are densely arranged.

SUMMARY OF THE INVENTION

In view of the above, it is an object of the invention to solve the above drawbacks residing in the prior art.

It is another object of the invention to provide a paper dust removal device detachably mountable to a frame provided in an image forming apparatus with simplified mounting and dismounting operations To accomplish the above objects, the present invention is directed to a paper dust removal device detachably mountable to a frame of an image forming apparatus through an opening formed on the frame to remove paper dusts from an outer surface of a roller in the image forming apparatus, the opening of the frame being opposing to the outer surface of the roller, the paper dust removal device comprises a base member; a paper dust holding member fixedly attached to the base member adapted to press contact with the outer surface of the roller; and engaging means engageable with the frame when the paper dust removal device is rotated in an engaging direction due to a friction force generated on the outer surface of the roller by a contact of the paper dust holding member with the outer surface of the roller.

Preferably, the paper dust removal device may further comprise an elastic member disposed between the paper dust holding member and one side of the base member. And the engaging means is fixedly attached to the opposite side of the base member and projects therefrom to be engageable with the frame. Further, it may be preferable that the base member is formed with a tapered portion on the opposite side thereof at an edge opposing to where the engaging means is.

Preferably, the paper dust removal device may further comprise the frame having a length substantially equal to the axial length of the roller and the frame is integrally formed with a top member, a vertical member, and a bottom member, the vertical member has a specified portion which is cut and bent to form a support portion of the bottom member and to form an engaging hole of the vertical member at a position corresponding to the cutout portion through which the engaging member is engaged with the frame.

It may be preferable that the top member, the vertical member and the support portion of the bottom member define the opening of substantially U-shape in cross section to accommodate the dust holding member and the base member therein.

Further, it may be preferable that the engaging means includes a plurality of engaging members arranged spaced apart by a specified interval along the lengthwise direction of the base member.

With the above arrangements, the base member of the paper dust removal device is formed with the engaging member engageable with the frame of the image forming apparatus when the paper dust removal device is rotated in the engaging direction due to the friction force resulting from the press contact between the outer circumferential surface of the roller and the dust holding member.

Further, since the frame is integrally formed with the top member, the vertical member, and the bottom member, and the engaging hole of the vertical member and the support portion of the bottom member can be formed at the same time by cutting the contour of the support member except the lower end thereof and bending the same by 90 degree, a manufacturing process in producing the frame can be facilitated.

Further, when the paper dust removal device is mounted to the frame through the opening, the mounting operation is facilitated by rotating the paper dust removal device in the engaging direction, while inserting the engaging member into the engaging hole. In the mounted state, the paper dust removal device in pressing contact with the roller is exerted with the friction force when the roller is rotated in a specified direction. The direction along which the friction force is acted upon the paper dust removal device is same as the engaging direction, the paper dust removal device therefore is securely held in the frame in a state that the engaging member is engaged with the frame.

In detaching the paper dust removal device from the frame, the dismounting operation can also be facilitated by rotating, the paper dust removal device in the disengaging direction, opposite to the engaging direction to release the engagement between the engaging member and the frame. In this way, the paper dust removal device can be mounted to and dismounted from the frame with ease, thereby facilitating maintenance of the paper dust removal device.

Provision of the tapered portion on the base member also facilitates attaching and detaching operations of the paper dust removal device since the base member can be mounted to and dismounted from the frame, while smoothly guided by the tapered portion along the support portion of the frame.

The above and other objects, features and advantages of the present invention will become more apparent upon a reading of the following detailed description and drawings.

DETAILED DESCRIPTION OF THE PREFERRED EMBODIMENTS OF THE INVENTION

A preferred embodiment of the present invention is described with reference to the accompanying drawings.

Figure 1:
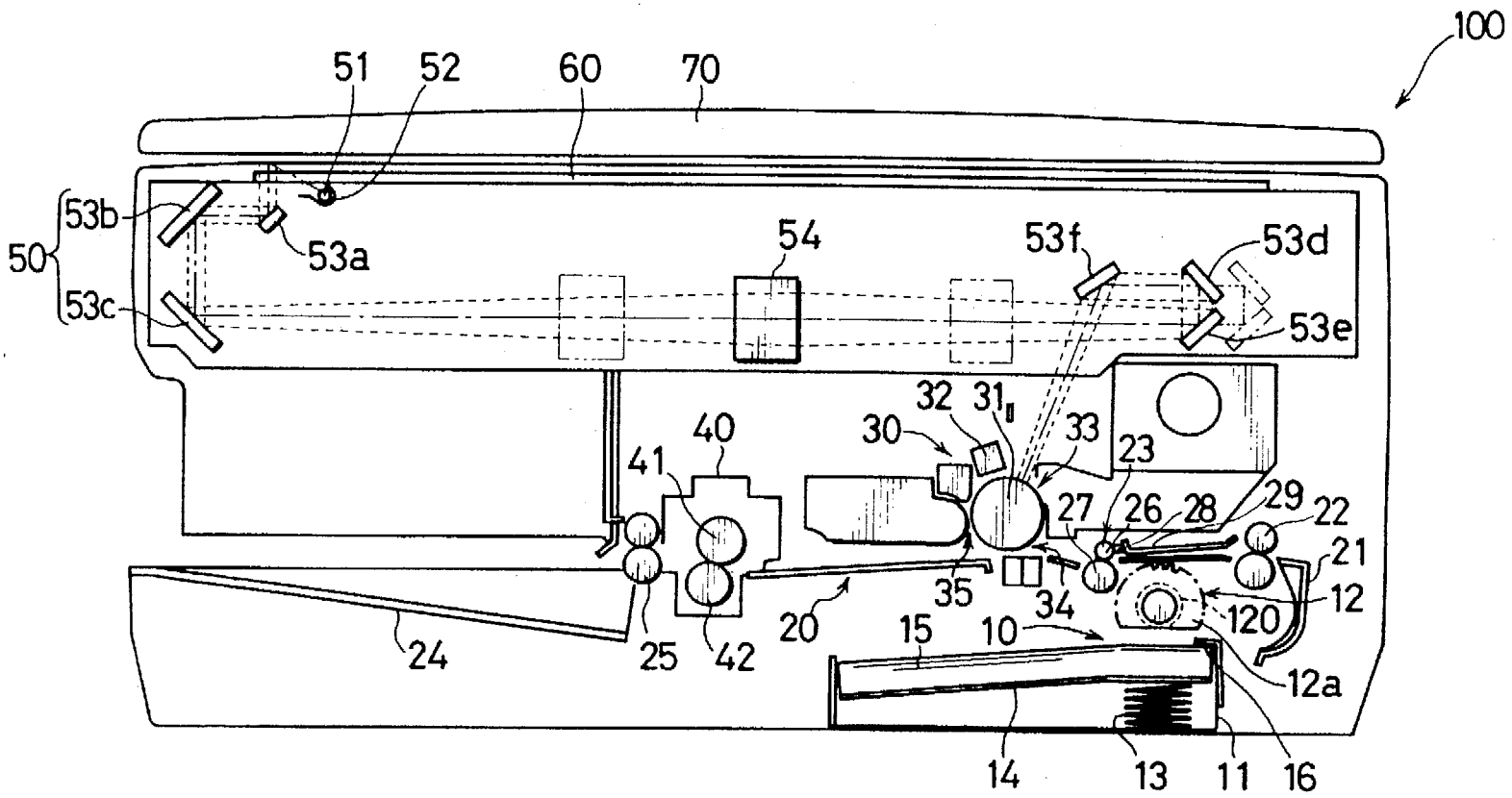
FIG. 1 is a cross sectional view showing an internal arrangement of an image forming apparatus incorporated with a paper dust removal device according to this invention.

FIG. 1 is a cross sectional view showing an internal arrangement of an image forming apparatus provided with a paper dust removal device embodying this invention.

In FIG. 1, denoted at 100 is a main body of such image forming apparatus. The apparatus main body 100 comprises a paper storage portion 10 disposed at a lower portion thereof, a sheet transport unit 20 disposed above the paper storage portion 10, an imaging assembly 30 arranged above the sheet transport unit 20, a fixing unit 40 disposed downstream of the imaging assembly 30 with respect to a sheet transport direction, and an optical unit 50 provided above the imaging assembly 30 and fixing unit 40. The apparatus main body 100 further has a contact glass 60 and a document presser 70 at a top portion thereof. The contact glass 60 and the document presser 70 are disposed in the middle of the top portion of the apparatus main body 100. The document presser 70 presses a document placed on the contact glass 60 by a specified pressure.

The paper storage portion 10 comprises a cassette 11 and a feed roller 12. The cassette 11 has a sheet placement plate 14 with a lead end thereof urged upward by a spring 13. Copy sheets stacked on the sheet placement plate 14 are dispensed from the cassette 11 one by one in such a way that an uppermost copy sheet 15 in contact with the feed roller 12 is fed by the feed roller 12, while being separated from the other stacked copy sheets in a state that opposite lead ends in the widthwise direction of the copy sheet are temporarily retained respectively by restricting pieces (claws) 16 provided at lead end corner positions of the cassette, corresponding to the opposite lead ends of the copy sheet.

The feed roller 12 is disposed above the cassette 11 at an appropriate position corresponding to a lead portion of copy sheets in the cassette 11 with respect to the sheet transport direction in a state that an outer circumferential surface of the feed roller 12 comes into pressing contact with an upper surface of the uppermost copy sheet 15. The feed roller 12 is rotatably supported about an axis of a rotary shaft which is driven by a motor 120 illustrated by the dotted line in FIG. 1. It is to be noted that the axial direction of the rotary shaft is orthogonal to the sheet transport direction, i.e., in parallel with the widthwise direction of copy sheet.

The feed roller 12 has a hemispherical portion 12*a* which has a substantially semicircle in cross section. An outer portion of the hemispherical portion 12*a* is indented by a specified pitch to generate a large friction force between the rotating roller 12 and copy sheet 15.

The sheet transport unit 20 includes an inverting guide member 21 for inverting the direction of feeding the copy sheet 15 which has been dispensed from the cassette 11 by the feed roller 12. The sheet transport unit 20 further comprises a transport roller pair 22, a registration roller pair 23, a discharge tray 24, and a discharge roller pair 25 arranged from upstream side in this order with respect to the sheet transport direction. The copy sheet 15 whose transport direction is inverted by the inverting guide member 21 is transported toward the imaging assembly 30. Specifically, the thus fed copy sheet 15 is transported toward the imaging assembly 30 by the registration roller pair 23 in synchronism with a scan timing by the optical unit 50, and discharged onto the discharge tray 24 via the discharge roller pair 25 after the image formation.

The registration roller pair 23 comprises an upper roller 26 and a lower roller 27. The upper roller 26 and lower roller 27 are disposed opposing to each other in a state that their respective outer circumferential portions come into pressing contact by the self weight of the upper roller 26 to allow the copy sheet 15 to pass therebetween. Rotary shafts of the upper and lower rollers 26 and 27 are arranged in parallel to each other, and the copy sheet is transported for image formation in the imaging assembly 30 as timed with a scan timing by the optical unit 50 in a state that a lead end of the copy sheet is temporarily nipped by the registration roller pair 23.

A snap-in type paper dust removal device 28 is fittingly accommodated in a frame 29 in a state that it comes into pressing contact with the outer circumferential surface of the upper roller 26 over its entire length along the axial direction of the rotary shaft of the upper roller 26. It is to be noted that the paper dust removal device 28 is arranged on the side of the upper roller 26 in view of the fact that an image is transferred onto the side of copy sheet facing the upper roller 26 in this embodiment.

The paper dust removal device 28 is detachably mounted to the frame 29 to facilitate regular maintenance such as cleaning and replacement with a new paper dust removal device. The paper dust removal device 28 is adapted for removing paper dusts adhered on the outer circumferential surface of the upper roller 26, thereby preventing the paper dusts from depositing on the roller 26 and affecting adversely a transfer unit and cleaning unit which will be described later.

The imaging assembly 30 has a photosensitive member 31 in the form of a drum which is rotatably supported about its rotary axis. There are main charger 32, developing unit 33, transfer/separation unit 34, and cleaner 35 in the periphery of the photosensitive drum 31 from upstream side in this order with respect to the rotating direction of the photosensitive drum 31.

The main charger 32 charges a surface of the photosensitive drum 31 uniformly at a specified potential. A specified area of the photosensitive drum surface, immediately downstream of the main charger 32 is exposed to a light image of original document directed from the optical unit 50 to form an electrostatic latent image thereon. The developing unit 33 is adapted for developing the latent image into a toner image. The transfer/separation unit 34 is adapted for transferring the toner image onto the copy sheet 15 and separating the copy sheet 15 after the image transfer from the surface of the photosensitive drum 31. The cleaner 35 removes residues of electric charges on the photosensitive drum surface and also removes residues of toner particles on the photosensitive drum surface after the image transfer.

The fixing, unit 40 has a heater roller 41 and a presser roller 42 and is adapted for fixing the transferred toner image on the copy sheet 15 which is separated from the surface of the photosensitive drum 31. The heater roller 41 is internally provided with a heater. The presser roller 42 has a surface thereof made of a material slightly softer than the surface of the heater roller 41, and is pressed against the heater roller 41 with a specified pressing force.

The optical unit 50 comprises an exposure lamp 51, a reflector 52 for directing light emitted from the exposure lamp 51 toward the document surface, reflective mirrors 53*a*, 53*b*, 53*c*, 53*d*, 53*e*, and 53*f* for guiding the light reflected from the document surface to the image exposure area on the photosensitive drum surface, and a lens unit 54. The exposure lamp 51, reflector 52, and reflective mirrors 53*a*, 53*b*, and 53*c* are reciprocally movable in the left and right side directions in FIG. 1 by specified speeds, respectively. Thereby, an image on the document surface is scanned to generate a light image of document image. The reflective mirrors 53*d* and 53*e* are movable together with the lens unit 54 to obtain a desired magnification ratio.

Next, the arrangement of the paper dust removal device 28 embodying the present invention and mounting/dismounting operations of the paper dust removal device 28 to and from the frame 29 will be described in details.

Figure 2:
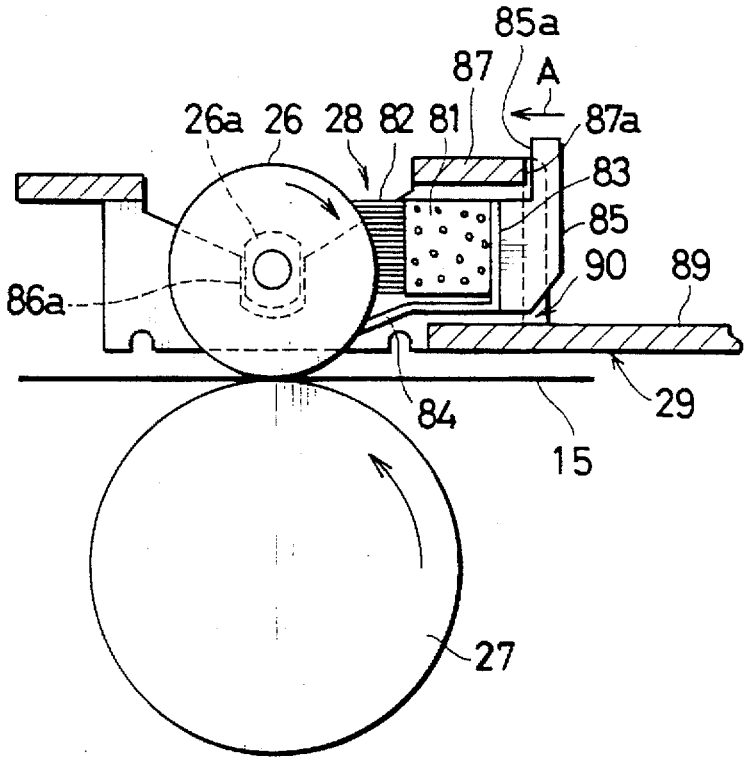
FIG. 2 is a cross sectional side view showing an arrangement of the paper dust removal device and a pair of registration rollers.
Figure 3:
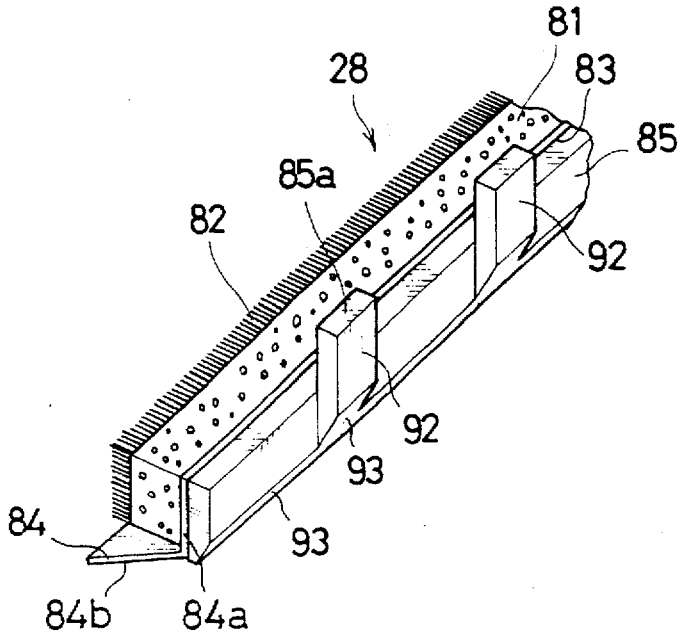
FIG. 3 is a perspective view partially showing essential parts of the paper dust removal device.
Figure 4:
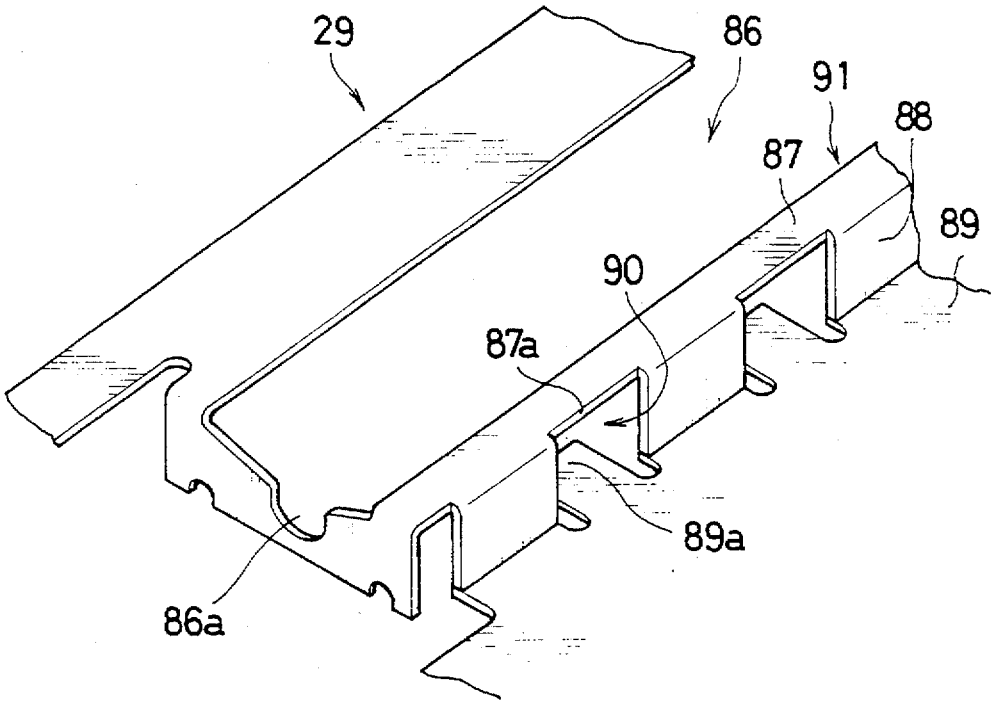
FIG. 4 is a perspective view partially showing an arrangement of a frame to which the paper dust removal device is to be mounted.

FIG. 2 is a cross sectional side view showing the arrangement of the paper dust removal device 28 and the registration roller pair 23. FIG. 3 is a perspective view partially showing essential parts of the paper dust removal device 28. FIG. 4 is a perspective view partially showing the frame 29 to which the paper dust removal device 28 is to be mounted.

In FIGS. 2 to 4, the paper dust removal device 28 comprises a paper dust holding member (brush) 82, elastic member (sponge) 81, and a base member (also referred to as a base) 85. The paper dust removal device 28 is constructed in such a manner that the paper dust holding member 82 composed of felt-like acrylic fiber is fixedly mounted to one side of the elastic member 81. The elastic member 81 at the side opposite to the paper dust holding member 82 is fixedly attached to the base 85 over its entire length by an adhesive member 83 such as adhesive agent and double-sided adhesive tape whose opposite sides have a property of adhesion. The base 85 has an elongated shape and extends substantially over the axial length of the rotary shaft of the upper roller 26, and has a specified height.

The lead end of the brush 82 comes into pressing contact with the outer circumferential surface of the upper roller 26 over the entire axial length of the roller 26. Specifically, when the registration roller pair 23 is rotated, paper dusts adhered on the outer circumferential portion of the upper roller 26 are raked by the lead end of the brush 82 in pressing contact therewith to be accumulated therein, thereby removing the paper dusts from the roller surface.

A polyethylene terephtalate film (PET film) 84 is sandwiched between the elastic member 81 and the base 85 by means of adhesive member. The PET film 84 has an upright portion 84*a* and an extension 84*b* extending from the lower end of the upright portion 84*a* when the paper dust removal device 28 is mounted to the frame 29. The PET film 84 is fixedly mounted to the base 85 in such a way that the upright portion 84*a* is attached to the base 85 over its entire length by the adhesive member 83. The extension 84*b* is tilted slightly downward toward the upper roller 26 with its lead end coming into contact with the outer circumferential surface of the upper roller 26 over its entire length. The extension 84*b* is located below the sponge 81 and brush 82 and is adapted for receiving paper dusts, thereby preventing the paper dusts from falling onto the upper surface of copy sheet 15.

Figure 5:
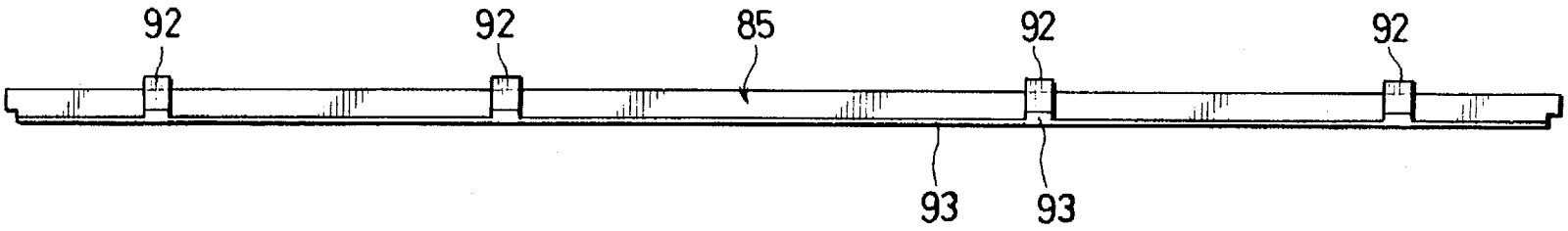
FIG. 5 is a rear view of a base of the paper dust removal device.

As shown in FIG. 5, the base 85 is provided with engaging members 92 (in this embodiment, four engaging members) on the side opposite to the side where the brush 82 is provided. The engaging members 92 are arranged spaced apart by a specified interval along the longitudinal direction of the base 85.

The engaging member 92 is fixedly attached to the base 85 by an adhesive member or equivalent in a state that an upper portion 85*a* is protruded by a specified dimension to form a projection. The upper portion 85*a* of the engaging member 92 is engaged with an upper side end 87*a* of the frame 29 when the paper dust removal device 28 is fixedly mounted to the frame 29. The construction of the frame 29 is described later in details.

The engaging member 92 is further formed with a tapered portion 93 at a lower end of the base 85, opposite to the upper portion 85*a*. The tapered portion 93 is tapered as approaching toward the lower end of the base 85. Provision of the tapered portion 93 facilitates attaching and detaching operations of the paper dust removal device 28 to and from the frame 29.

Next, the construction of the frame 29 is described. As shown in FIG. 4, the frame 29 is formed with a housing portion 86 in the form of a hollow at a specified position in the proximity of one lateral end thereof. The housing portion 86 is adapted for accommodating the upper roller 26 therein. The frame 29 is formed with cutout portions 86*a*, 86*a* (in FIG. 4, only one cutout portion is shown) at opposite ends in the axial direction of the upper roller 26. The cutout portions 86*a* are adapted for rotatably supporting the upper roller 26 by receiving bearings for the rotary shaft of the upper roller 26.

On the right side of the housing portion 86 in FIG. 4, the frame 29 is integrally formed with top wall 87, vertical wall 88, and bottom wall 89 in continuity. The vertical wall 88 is perforated by a punching operation at a specified position corresponding to the engaging members 92 of the paper dust removal device 28, and the portion whose three sides are surrounded by the perforation is set to orthogonal to the vertical wall and parallel to the bottom wall 89. The openings on the vertical wall 88 created by the portions 89*a* put into the posture orthogonal to the vertical wall 88 form an engaging holes 90 of the vertical member 88, and at the same time, the portions 89*a* by themselves form support portions 89*a* of the bottom wall 89. When the engaging holes 90 are formed, the top wall 87 is formed with upper side ends 87*a* at a specified position corresponding to the engaging members 92.

The support portion 89a of the bottom wall 89 has a specified dimension extending toward the housing portion 86. When viewed from the front side in FIG. 1, the top wall 87, vertical wall 88 and support portion 89*a* of the bottom wall 89 define a substantially U-shaped fitting portion (opening) 91 for fittingly holding the paper dust removal device 28 therein. The fitting portion 91 is opened toward the outer circumferential portion of the upper roller 26.

When the paper dust removal device 28 is mounted to the frame 29, it is accommodated in the fitting portion 91 in a state that the brush 82 opposes the upper roller 26. In this state, the upper side ends 87*a* of the top wall 87 are engaged with the corresponding projections 85*a* of the paper dust removal device 28 in the following manner.

Specifically, when the upper roller 26 is rotated in the clockwise direction as shown in FIG. 2, a friction force is generated between the outer circumferential surface of the upper roller 26 and the lead end of the brush 82, because the brush 82 is pressed against the upper roller 26 by a specified pressure. Because of the friction force generated in between, the paper dust removal device 28 as a whole is applied with a force to be rotated in the counterclockwise direction about the lower end of the base 85 which serves as a support. Thereby, the upper portions (projections) 85*a* of the device 28 are given with a force acting in the direction shown by the arrow A in FIG. 2, thereby securing engagement between the projections 85*a* of the paper dust removal device 28 and the upper side ends 87*a* of the frame 29.

An image formation by the image forming apparatus incorporated with the thus-constructed paper dust removal device 28 which is fixedly mounted to the frame 29 is described hereinafter.

When a copying is instructed, the feed roller 12 is started to be driven. Each time when the feed roller 12 makes one turn, copy sheets stacked on the sheet placement plate 14 of the cassette 11 are dispensed one by one in a state that the indented outer circumferential portion of the feed roller 12 comes into pressing contact with the upper surface of the uppermost copy sheet 15, thereby transporting the uppermost copy sheet in the sheet transport direction due to the friction resistance between the outer circumferential portion of the feed roller 12 and the upper surface of the copy sheet, while being separated from the other stacked copy sheets by the restricting pieces 16.

The copy sheet 15 thus dispensed from the cassette 11 is transported to the transport roller pair 22 after having its transport direction inverted by the inverting guide member 21, and further transported to the registration roller pair 23. At this time, the registration roller pair 23 is driven in such a manner that the lead end of the copy sheet 15 is temporarily nipped therebetween as timed with a scan timing by the optical unit 50, thereby transporting the copy sheet 15 toward the image transfer unit.

The paper dust removal device 28 is fixedly mounted to the frame 29 in a state that the brush 82 composed of felt-like fiber comes into pressing contact with the outer circumferential portion of the upper roller 26 of the registration roller pair 23 in the following manner. Accompanied by a rotation of the upper roller 26 in the clockwise direction in FIG. 2, a friction force is generated between the outer circumferential portion of the upper roller 26 and the brush 82 of the paper dust removal device 28. The friction force is a force acting upon the paper dust removal device 28 to rotate the same in the counterclockwise direction about the lower end of the base 85 of the device 28. A force vector indicated by the arrow (representing the direction of the force vector) at the upper portion of the dust removal device thus the force is hereinafter also referred to as engaging force. When the upper roller 26 is rotated in the clockwise direction, the paper dust removal device 28 is firmly biased to the frame 29 because the projections 85*a* are engaged with the upper side ends 87*a* of the frame 29 by the engaging force exerted in the A-direction. Thus, the device 28 is fittingly retained in the U-shaped fitting portion 91 of the frame 29.

More specifically, when the upper roller 26 is rotated, the paper dust removal device 28 is given the engaging force which is opposite to a releasing force exerted in the clockwise direction to release an engaged state of the device 28 with the frame 29. Accordingly, the paper dust removal device 28 is securely held in the fitting portion 91 without the fear of disengagement of the device 28 from the frame 29. Thus, paper dusts on the outer circumferential surface of the upper roller 26, which have been attracted from the copy sheet 15 being transported between the registration roller pair 23 and adhered on the outer circumferential surface of the upper roller 26, are securely collected by the felt-like brush 82.

Next, when the copy sheet 15 is transported to the transfer/separation unit 34 of the imaging assembly 30, a toner image obtained from a light image of document image is transferred onto the copy sheet passing on the surface of the photosensitive drum 31 in a favorable state, because the paper dust removal device 28 securely removes the paper dusts on the outer circumferential surface of the upper registration roller 26, and hence there is no likelihood that the upper surface of the copy sheet 15 carries the paper dusts thereon. After the image transfer, the copy sheet carrying the toner image is separated from the surface of the photosensitive drum 31. Thereafter, the copy sheet 15 has its transferred toner image fixed thereon, while passing through the heater roller 41 and the presser roller 42 of the fixing unit 40, and is discharged on the discharge tray 24 via the discharge roller pair 25.

Periodic maintenance is required for the paper dust removal device 28, such as cleaning and replacing with a new device 28, since the thus collected paper dusts are overflowed as copying operation is repeated. How the maintenance is conducted for the paper dust removal device 28 is described next.

In this embodiment, the image forming apparatus is of a so-called "cram-shell" type in which an upper unit of the apparatus main body is pivotally rotatable upward and downward relative to a lower unit of the apparatus main body about a pivot disposed in the proximity of the inverting guide member 21 to respectively open and close the apparatus.

Figure 6:
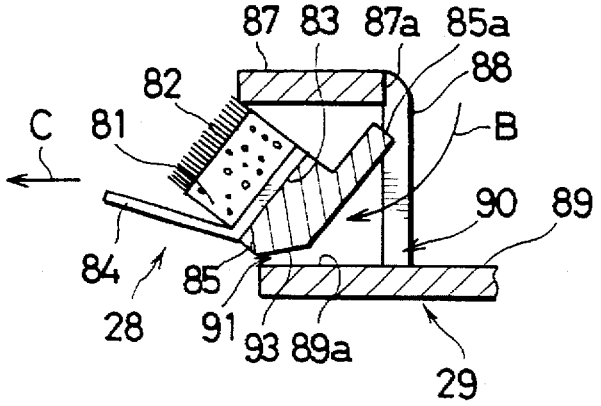
FIG. 6 is a diagram showing a state as to how the paper dust removal device is detached from the frame.

In case that the device 28 is detached from the frame 29, the upper unit is rotated upward to expose the internal devices of the image forming apparatus to outside. Next, the upper roller 26 of the registration roller pair 23 is taken out from the apparatus main body through the housing portion 86 by lifting up the upper roller 26 together with the bearings 26*a*, 26*a* which are supported on the cutout portions 86*a*, 86*a*, thus rendering the housing portion 86*a* hollow. Then, the engagement between the projections 85*a* and the upper side ends 87*a* is released by rotating the paper dust removal device 28 in the clockwise direction (releasing direction) shown by the arrow B in FIG. 6, while sliding the tapered portions 93 of the paper dust removal device 28 along the support portions 89*a*. Then, the paper dust removal device 28 is detached from the fitting portion 91 of the frame 29 in the direction shown by the arrow C in FIG. 6. The paper dust removal device 28 after the detaching operation is cleaned by removing paper dusts cumulatively held in the brush 82 and wiping off the paper dusts deposited on the film 84.

Thereafter, when the paper dust removal device 28 after cleaning up is to be mounted again in the fitting portion 91 of the frame 29 or when a new paper dust removal device is to be mounted, the mounting operation is conducted in the way reversing the dismounting operation. Specifically, the device 28 is fitted in the fitting portion 91 of the frame 29 by inserting the engaging members 92 into the corresponding engaging holes 90 of the frame 29 from the projections 85*a*, while slidingly rotating the device 28 in the counterclockwise direction (engaging direction), opposite to the direction shown by the arrow B in FIG. 6. When the device 28 is rotated to the state that the projections 85*a* of the device 28 are engaged with the corresponding upper side ends 87*a* of the frame 29, the device 28 is no longer rotated, i.e., has its rotation stopped by the engagement between the projections 85*a* and the upper side ends 87*a*, thereby securing a snap-in state of the device 28 in the fitting portion 91 of the frame 29. Also in this mounting operation, provision of the tapered portions 93 enables smooth guiding, along the corresponding support portions 89*a* of the frame 29.

As mentioned above, the brush (dust holding member) 82 made of felt-like acrylic fiber is pressed against the outer circumferential portion of the upper registration roller 26 by a specified pressure, and the base 85 of the paper dust removal device 28 is formed with a projection 85*a* engageable with the upper side end 87*a* of the frame 29. With this construction, when a friction force is generated between the upper registration roller 26 rotating in the clockwise direction and the brush 82, the paper dust removal device 28 is applied with a force to rotate the same in the engaging direction. Thus, as the upper roller 26 is rotated, the projections 85*a* of the paper dust removal device 28 are securely engaged with the upper side ends 87*a* of the frame 29.

In dismounting the paper dust removal device 28 from the frame 29, the engaged state is released by rotating the paper dust removal device 28 in the releasing direction opposite to the engaging direction, thereby facilitating the dismounting operation. On the contrary, in mounting the paper dust removal device 28 in the frame 29, the paper dust removal device 28 can be fittingly mounted to the frame 29 by rotating the device 28 in the engaging direction, thereby bringing the projections 85*a* into engaged state with the upper side ends 87*a*. Thus, the mounting operation can also be facilitated.

In this embodiment, the paper dust removal device 28 is formed with the projections 85*a*, while the frame 29 is formed with the upper side ends 87*a* engageable with the corresponding projections 85*a*. Alternatively, the frame 29 is formed with projections protruding downward from a backside surface of the top wall 87 to form engageable members with which the projections 85*a* of the device 28 are to be engaged. This arrangement can un-necessitate a provision of the engaging holes 90 in the frame 29.

Figure 7:
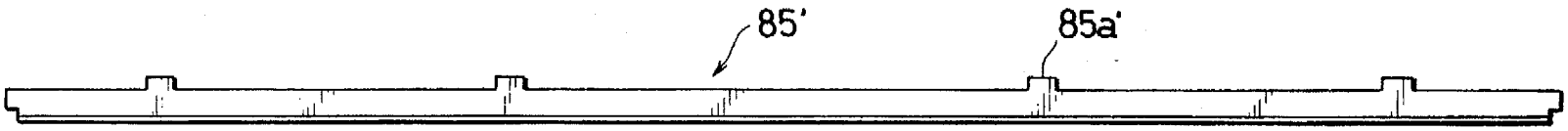
FIG. 7 is a rear view of an altered form of the base.
Figure 8:
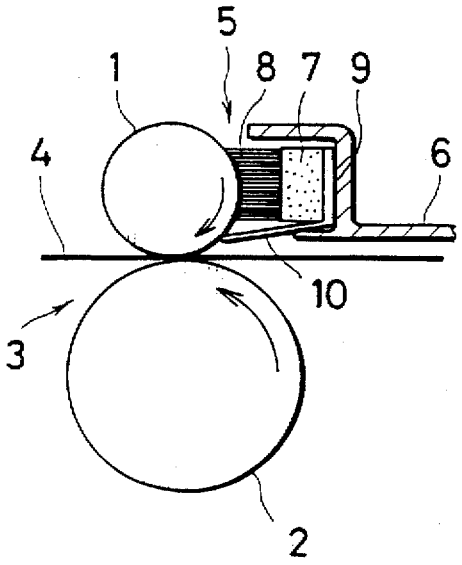
PRIOR ART FIG. 8
FIG. 8 is a cross sectional side view showing an arrangement of registration roller pair and paper dust removal device of the prior art.

In the foregoing embodiment, as shown in FIG. 5, the engaging members 92 are attached to the base 85 spaced apart by a specified interval along the entire length of the device 28 by adhesive member such as adhesive agent and double-sided adhesive tape in such a manner that a specified portion thereof projects upward to form the projections 85*a*. Alternatively, a base 85' may be formed with projections 85*a*' serving as engaging members, as shown in FIG. 7. The engaging members 85*a*' are formed spaced apart by a specified interval along the entire length of the base 85'. In this altered form, the engaging members can be integrally formed with the base 85', thereby reducing the number of parts and also eliminating the additional process of attaching the engaging members 92 to the base 85.

Further, in the foregoing embodiment, the vertical wall 88 is formed with engaging holes 90. Instead of this arrangement, the top wall 87 may be formed with engaging holes through which the corresponding projections 85*a* of the paper dust removal device 28 are to be inserted, thereby fittingly engaging the paper dust removal device with the frame. In this case, mounting and dismounting operations can also be facilitated as in the above embodiment.

In the aforementioned embodiment, the paper dust removal device 28 is fittingly mounted in the fitting portion 91 of the frame 29 by rotating the paper dust removal device 28 in the engaging direction about its rotary axis extending in parallel with the lower end of the base 85 in the longitudinal direction of the device 28 and securing the engagement between the projections 85*a* of the device 28 and the upper side ends 87*a* of the frame 29. Alternatively, the top wall 87 of the frame 29 may be designed to be swingable, i.e., openable. In this case, the projections 85*a* of the device 28 may be set to engage with the upper side ends 87*a* of the frame 29. The paper dust removal device is securely fitted in the flame 29 by first opening the top wall 87, then inserting the device 28 in the frame 29 through the opening and then closing the top wall 87.

In case that the upper roller 26 has a small diameter, possibly smaller than the radial projected amount of the contour of the bearing portion 26*a* of the roller in cross section, a withdrawal movement of the paper dust removal device 28 in the lengthwise direction (coming out of the sheet) in FIG. 2 may be obstructed by the bearing portion 26*a* of the upper roller. However, if the registration upper roller 26 has a relatively large diameter, i.e., greater than that of the maximum radial projection of the contour of the bearing portion 26a of the upper roller 26, then the device 28 can be taken out in the lengthwise direction (coming out or coming into the sheet) in FIG. 2. In the latter case, the base of the paper dust removal device 28 may be formed with projections or flanges to secure an engaged state between the device 28 and the frame 29. Thus, the device 28 can be mounted to and dismounted from the frame 29 by sliding in and out the device 28 in the lengthwise direction thereof. In this case, the paper dust removal device 28 can also be detached from and attached to the frame 29 with ease operations, thereby facilitating maintenance of the device 28.

Although the present invention has been fully described by way of example with reference to the accompanying, drawings, it is to be understood that various changes and modifications will be apparent to those skilled in the art. Therefore, unless otherwise such change and modifications depart from the scope of the invention, they should be construed as being included therein.

What is claimed is:

1. A paper dust removal device detachably mountable to a frame of an image forming apparatus through an opening formed on the frame to remove paper dust from an outer surface of a roller in the image forming apparatus, the opening of the frame being opposing to the outer surface of the roller, comprising:

a base member;

a paper dust holding member fixedly attached to the base member adapted to press contact with the outer surface of the roller; and engaging means engageable with the frame when the paper dust removal device is rotated in an engaging direction due to a friction force generated on the outer surface of the roller by a contact of the paper dust holding member with the outer surface of the roller.

2. A paper dust removal device according to claim 1, further comprising an elastic member disposed between the paper dust holding member and one side of the base member and the engaging means is fixedly attached to the opposite side of the base member and projects therefrom to be engageable with the frame.

3. A paper dust removal device according to claim 2, wherein the base member is formed with a tapered portion on the opposite side thereof at an edge opposing to where the engaging means is.

4. A paper dust removal device according to claim 1, further comprising the frame having a length substantially equal to the axial length of the roller and the frame is integrally formed with a top member, a vertical member, and a bottom member, the vertical member has a specified portion which is cut and bent to form a support portion of the bottom member and to form an engaging hole of the vertical member at a position corresponding to the cutout portion through which the engaging member is engaged with the frame.

5. A paper dust removal device according to claim 4, wherein the top member, the vertical member and the support portion of the bottom member defines the opening with substantially U-shape in cross section to accommodate the dust holding member and the base member therein.

6. A paper dust removal device according to claim 1, wherein the engaging means includes a plurality of engaging members arranged spaced apart by a specified interval along the lengthwise direction of the base member.

* * * * *